US007128608B1

(12) United States Patent
Chen

(10) Patent No.: US 7,128,608 B1
(45) Date of Patent: Oct. 31, 2006

(54) MINI-USB CONNECTOR ASSEMBLY

(75) Inventor: Lu-Cheng Chen, Taipei (TW)

(73) Assignee: He-And Technology Co., Ltd., Taipei (TW)

( * ) Notice: Subject to any disclaimer, the term of this patent is extended or adjusted under 35 U.S.C. 154(b) by 0 days.

(21) Appl. No.: 11/312,707

(22) Filed: Dec. 21, 2005

(30) Foreign Application Priority Data

Jun. 7, 2005 (TW) ..... 94209479 U

(51) Int. Cl.
*H01R 13/648* (2006.01)

(52) U.S. Cl. ..... 439/607

(58) Field of Classification Search ..... 439/607–610, 439/676, 79

See application file for complete search history.

(56) References Cited

U.S. PATENT DOCUMENTS 6,203,344 B1 * 3/2001 Ito ..... 439/218
6,337,444 B1 * 1/2002 Liao ..... 174/135
6,394,852 B1 * 5/2002 Huang ..... 439/669
6,659,805 B1 * 12/2003 Siddiqui et al. ..... 439/668
6,964,586 B1 * 11/2005 Siddiqui ..... 439/669
7,033,218 B1 * 4/2006 Huang et al. ..... 439/607

* cited by examiner

*Primary Examiner*—Khiem Nguyen
(74) *Attorney, Agent, or Firm*—Rosenberg, Klein & Lee

(57) ABSTRACT

A mini-USB connector assembly is used to fasten the transfer speed. A mini-USB connector assembly includes a male USB connector and a female USB connector. The male USB connector includes an isolation body, a front metallic housing, a rear metallic housing and a plurality of terminals. The terminals are manufactured by an insert molding process, and the terminals are positioned alongside on the bottom surface of the extension plates. The female USB connector includes a corresponding isolation body, a corresponding metallic housing and a plurality of corresponding terminals. The corresponding terminals are manufactured by an insert molding process, and the corresponding terminals are positioned alongside on the bottom surface of the corresponding extension plates. The male USB connector and the female USB connector respectively have 12 terminals. Each terminal has one end, and the 12 terminals are divided into two rows and positioned longitudinally at the circuit board.

12 Claims, 5 Drawing Sheets

MINI-USB CONNECTOR ASSEMBLY

BACKGROUND OF THE INVENTION

1. Field of the Invention

The present invention relates to a mini-USB connector assembly, and in particular to a mini connector assembly with a universal series bus interface that is suitable for portable electronic appliance and is plug-and-play.

2. Description of Related Art

Universal Serial Bus (USB) interfaces are introduced to computer-related appliances. The USB interface is configured to support plug-and-play device and is hot-swappable. That is, the USB interface has a capability to be plugged or unplugged without removing the power or rebooting the computer. One USB connector is allowed for up to 127 peripherals to be attached including speakers, telephone sets, CD-ROM drives, joysticks, magnetic tap devices, keyboards, scanners and digital cameras. The USB connection ports are usually positioned near parallel ports or serial ports.

Especially, mini-USB ports are implemented in portable electronic appliances so that the portable electronic appliances are plug-and-play. To be compatible with current specification, the mini-USB ports are only configured with four terminals so that the mini-USB ports do not deal with demand for more data and higher transfer speed.

Thus, there is a need for a new mini-USB connector assembly.

SUMMARY OF THE INVENTION

It is an object of the present invention to provide a mini-USB connector assembly with more terminals to fasten the transfer speed without enlarging its volume.

To achieve object of the present invention, a mini-USB connector assembly includes a male USB connector and a female USB connector. The male USB connector includes an isolation body, a front metallic housing, a rear metallic housing and a plurality of terminals. The isolation body includes a main body and a extension plate extending from the main body. The extension plate is enclosed by the front metallic, and a top surface of the extension plate abuts against a top plate of the front metallic housing. An insertion space is formed between the extension plate and the front metallic housing. Periphery of the main body is enclosed by the rear metallic housing. The terminals are manufactured by an insert molding process, and the terminals are positioned alongside on the bottom surface of the extension plates and penetrate through the main body so that the terminals can be soldered to a circuit board. The female USB connector includes a corresponding isolation body, a corresponding metallic housing and a plurality of corresponding terminals. The corresponding isolation body includes a corresponding main body and a corresponding extension plate extending from the corresponding main body. The corresponding extension plate is positioned within the insertion space. The corresponding isolation body is enclosed by the corresponding metallic housing. In addition, the corresponding terminals are manufactured by an insert molding process, and the corresponding terminals are positioned alongside on the top surface and the bottom surface of the corresponding extension plates and penetrate through the corresponding main body so that the terminals can be soldered to a circuit board.

BRIEF DESCRIPTION OF THE DRAWINGS

The present invention can be fully understood from the following detailed description and preferred embodiment with reference to the accompanying drawings, in which.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
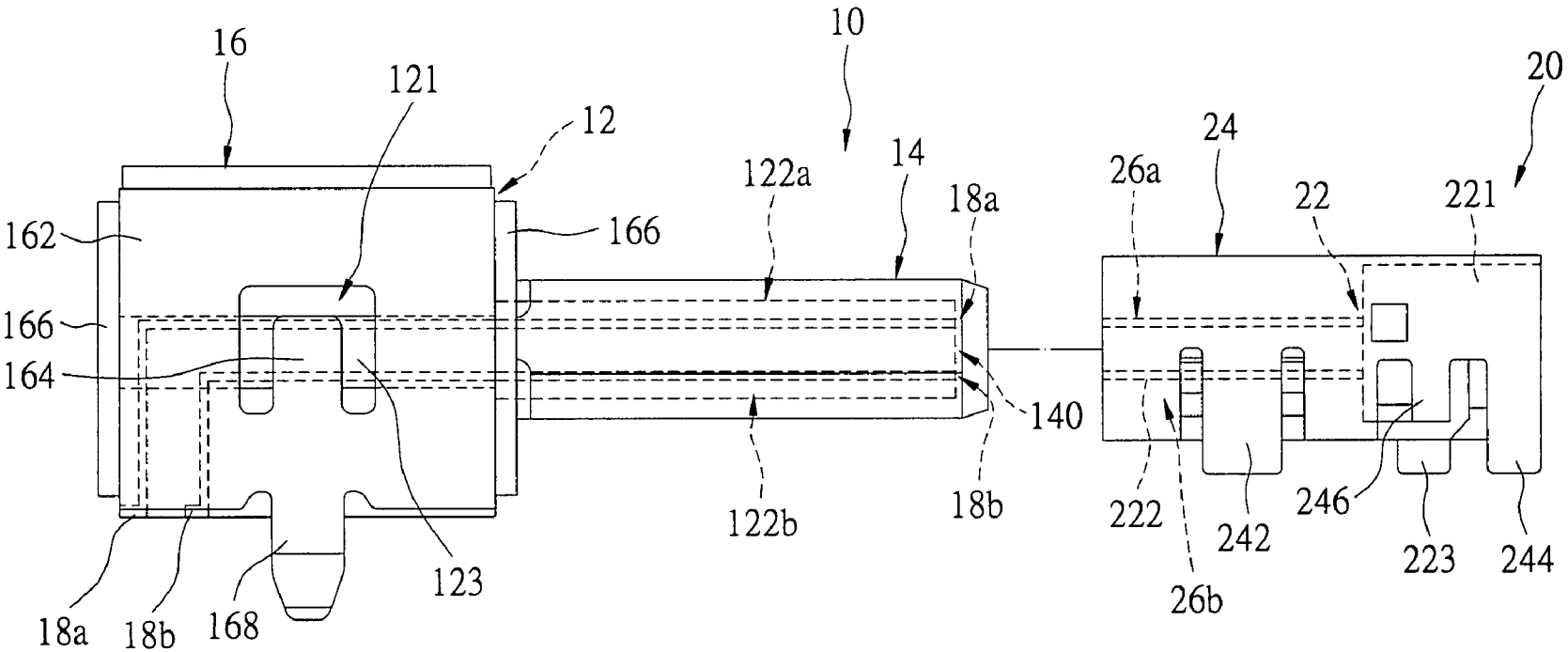
FIG. 1 is a side view of a mini-USB connector assembly according to the present invention.
Figure 2:
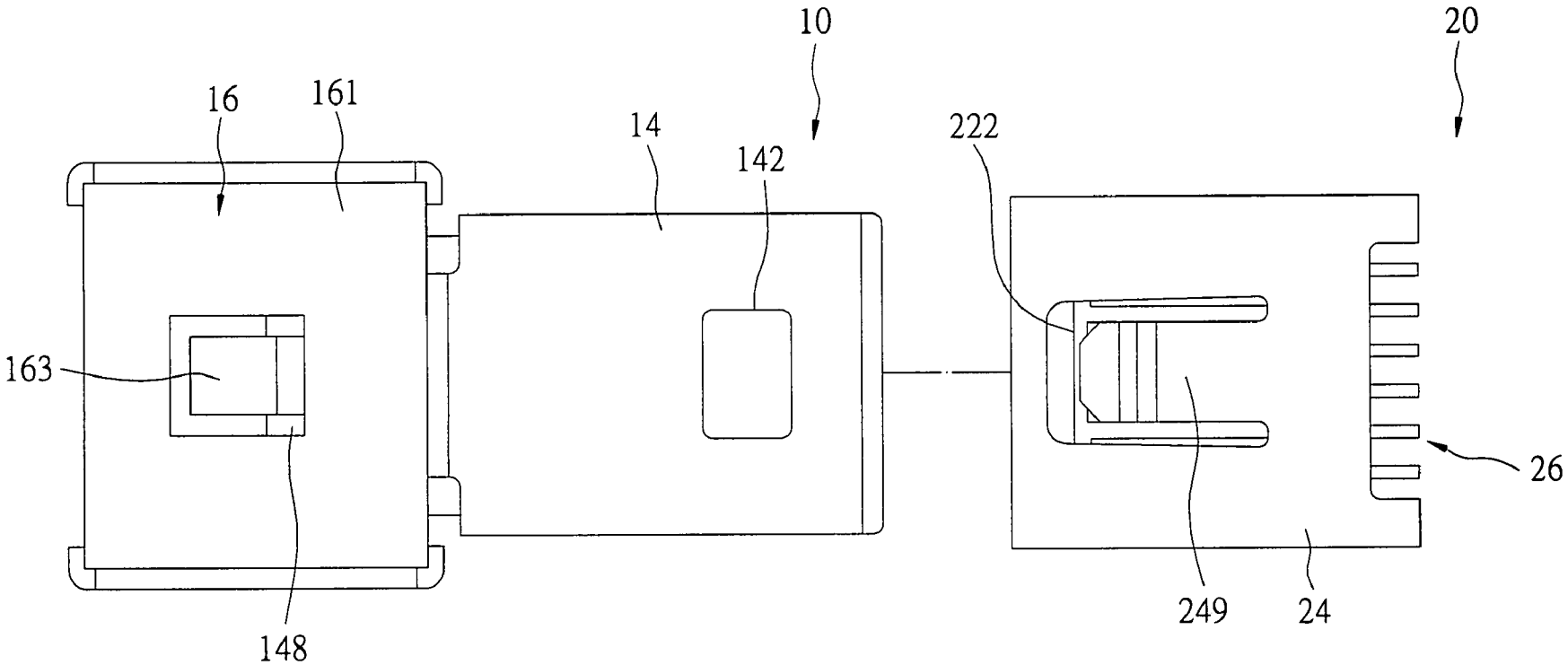
FIG. 2 is a top plan view of a mini-USB connector assembly according to the present invention.
Figure 3:
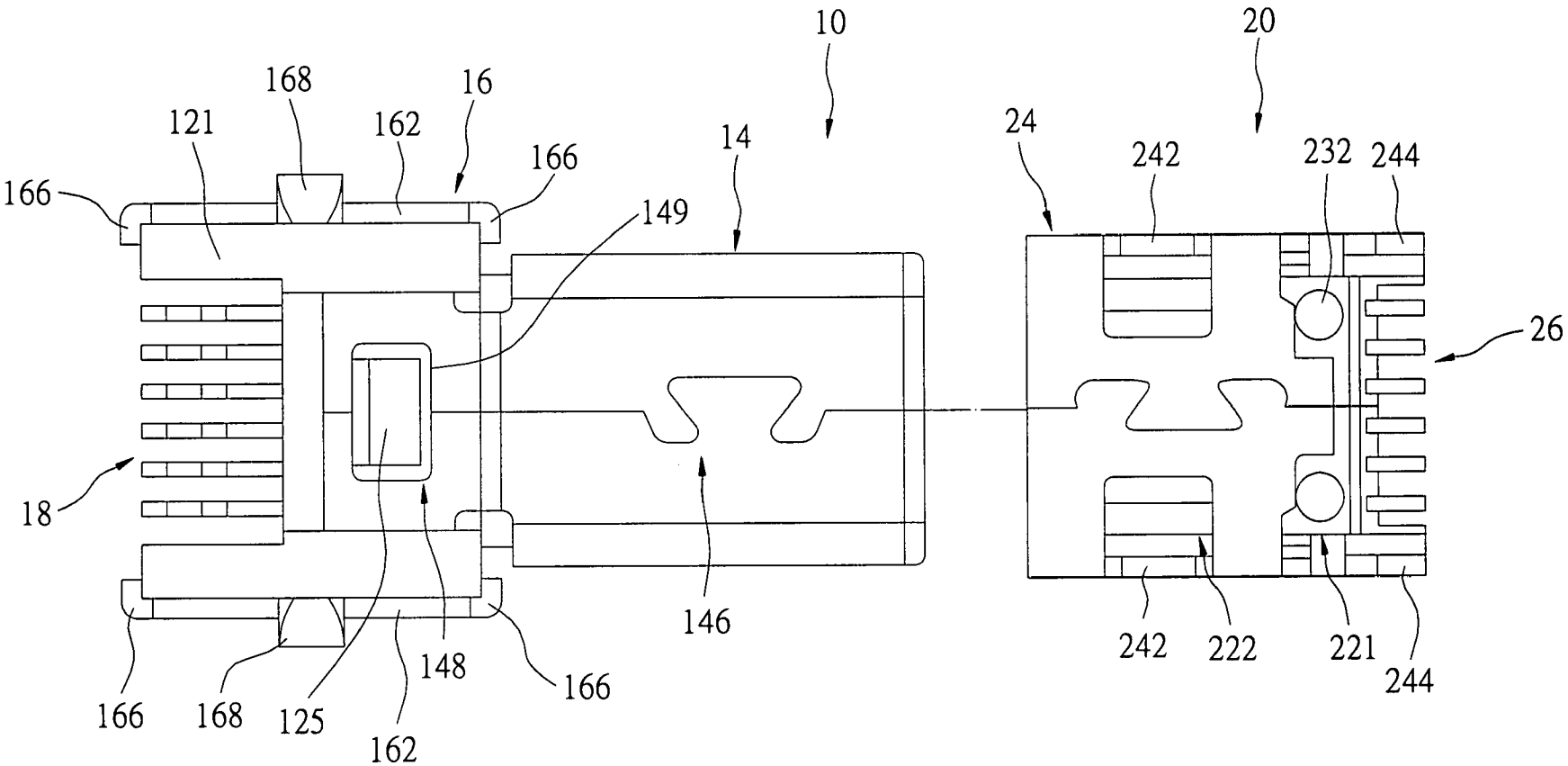
FIG. 3 is a bottom plan view of a mini-USB connector assembly according to the present invention.

Reference is made to FIGS. 1–3. FIGS. 1–3 respectively illustrate a side view, a top plan view and a bottom plan view of a mini-USB connector assembly according to the present invention. The present invention provides a mini-USB connector assembly including a male USB connector 10 and a female USB connector 20.

Figure 4:
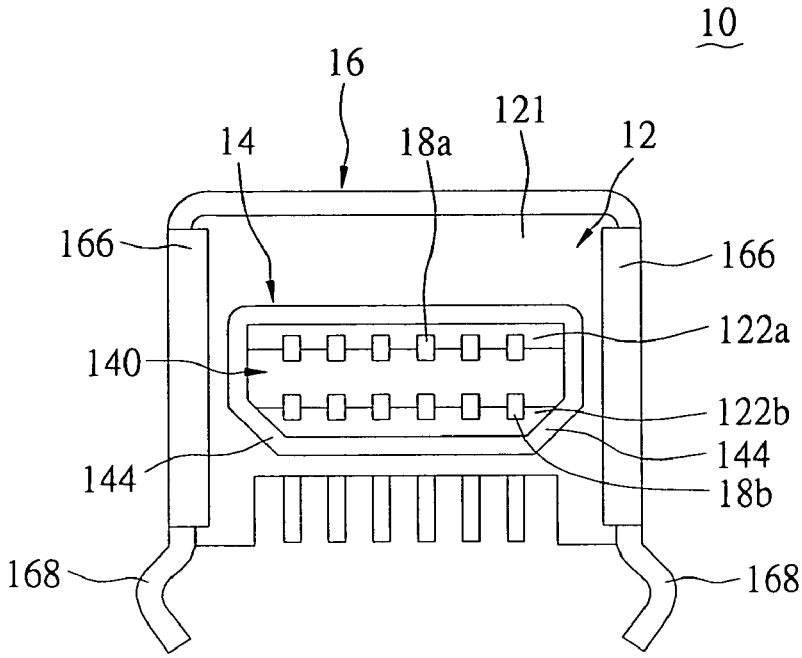
FIG. 4 is a front plan view of a male USB connector according to the present invention.
Figure 5:
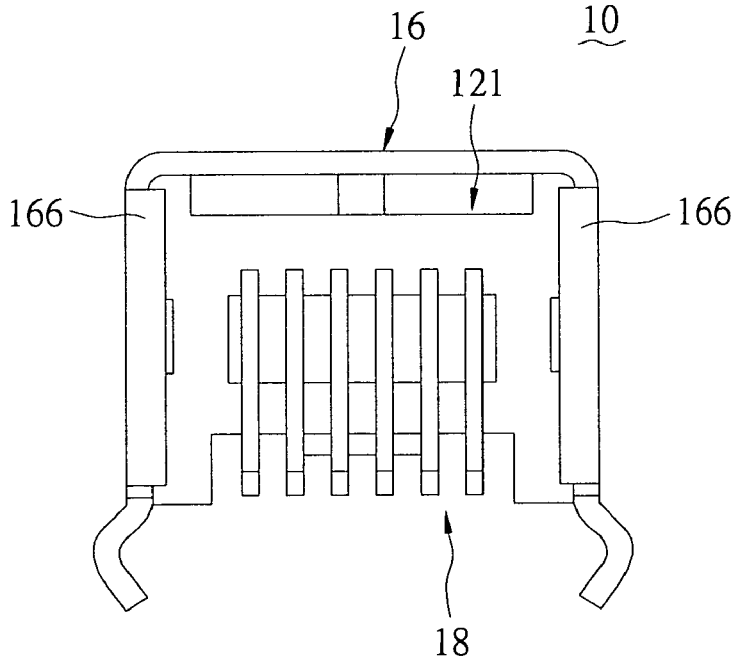
FIG. 5 is a rear plan view of a male USB connector according to the present invention.

To begin with, reference is made to FIGS. 4 and 5. FIGS. 4 and 5 illustrate a front plan view and a rear plan view of the male USB connector 10. The male USB connector 10 includes an isolation body 12, a front metallic housing 14, a rear metallic housing 16 and a plurality of terminals 18*a* and 18*b*. According to the present invention, the male USB connector 10 and the female USB connector 20 respectively have 12 terminals so that transfer speed is enhanced. The present invention is not limited to 12 terminals.

The isolation body 12 is made of isolation material and includes a main body 121 and a extension plate 122*a* and 122*b* extending from the main body 121. The terminals 18*a* and 18*b* are respectively positioned alongside at a bottom surface and a top surface of the extension plate 122 and penetrate through the main body 121 so that the terminals can be soldered to a circuit board (not shown).

Because the present invention includes 12 terminals, it is rather difficult to put the terminals into the male USB connector in an assembling way. According to the present invention, the terminals 18*a* and 18*b* are fixed within the isolation body 12 by an insert molding process without assembling by manpower. That is, the terminals are positioned within a mold of the isolation body 12 beforehand, and melt material is poured into the mold of the isolation body 12. In this regard, when the isolation body 12 is formed, the terminals 18*a* and 18*b* are already fixed therein.

The present invention has a prerequisite condition that the volume of the mini-USB connector assembly will not be enlarged. As shown in FIG. 5, the terminals 18*a* and 18*b* are respectively positioned in a row so that all soldering ends of the terminals 18*a* and 18*b* are arranged in two rows and are soldered to the circuit board in a staggered way. Such arrangement is better than that all the terminals are arranged in a row. The terminals of the present invention will not to be closed and it is easier when soldering.

Reference is made to FIGS. 1–3. The front metallic housing 14 of the male USB connector 10 is formed by bending metallic plate and is used to enclose the extension plates 122*a* and 122*b*. As shown in FIG. 3, a self-engagement portion 146 is formed at a bottom surface of the front metallic housing 14. As shown in FIGS. 1 and 4, a top surface of the extension plate 122*a* abuts against the top plate of the front metallic housing 14 and a bottom surface of the extension plate 122*b* abuts against the bottom plate of the front metallic housing 14 so that an insertion space 140 is formed between the extension plate 122*a* and 122*b*.

Reference is made to FIG. 3. The main body 121 of the isolation body 12 of the male USB connector 10 has engagement pieces 125 at its top surface and bottom surface. A corresponding engagement plate 148 extends from the front metallic housing 14 and has an engagement hole 149 in order to engage with the engagement piece 125 of the main body 121. (The engagement piece 125 at top surface is sheltered by the top plate 161 of the rear metallic housing 16 so the engagement piece 125 is not shown).

Reference is made to FIGS. 1–3. The rear metallic housing 16 of the male USB connector 10 is formed by bending metallic plate and is substantially U-shaped. The rear metallic housing 16 includes a top plate 161 and a pair of side plates 162 respectively used to enclose the top surface and two sides of the main body 121 of the isolation body 12. Reference is made to FIG. 2. A fixing plate 163 is formed at the top plate 161 of the male USB connector 10 by punching process and is used to push the main body 121 downwardly and abuts against the corresponding engagement plate 148 of the front metallic housing 14. Thus, the front metallic housing 14 is grounded via the rear metallic housing 16.

Reference is made to FIG. 1. A fixing plate 164 is formed at the side plates 162 of the rear metallic housing 16. Two guide grooves 123 are respectively positioned traverse at two sides of the main body 121 of the isolation body 12. The fixing plate 164 is used to push against the guide grooves 123. Thus, as shown in FIGS. 1 and 3, two engagement fringes 166 are respectively formed at the side plates 162 of the rear metallic housing 16 in order to engage with the main body 121 of the isolation body 12. In this regard, the main body 121 is firmly positioned within the rear metallic housing 16. The main body 121 is not only moved back and forth within the rear metallic housing 16 but the main body 121 is also moved along the vertical direction within the rear metallic housing 16 by the fixing plate 164. Two fixing extensions 168 are integrally formed with and extend from the side plate 162 of the rear metallic housing 16 so that the rear metallic housing 16 can be fixed at the circuit board.

Figure 6:
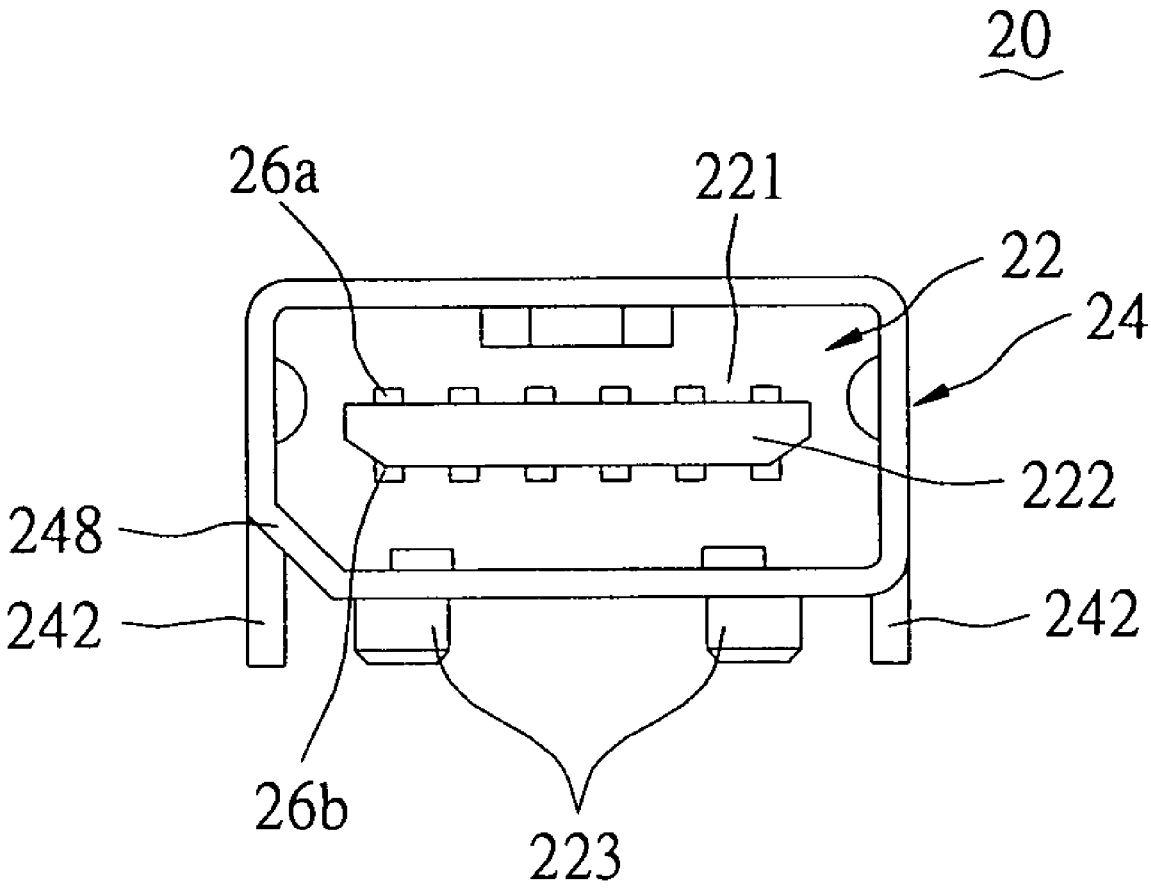
FIG. 6 is a front plan view of a female USB connector according to the present invention.

Reference is made to FIGS. 1–3 and 6. FIG. 6 illustrates the female USB connector 20 of the present invention. According to the present invention, the female USB connector 20 corresponds with the male USB connector 10 and includes a corresponding isolation housing 22, a corresponding metallic housing 24 and a plurality of terminals 26*a* and 26*b*. The corresponding isolation body 22 includes a corresponding main body 221 and a corresponding extension plate 222 extending from the corresponding main body 221. A shape of the corresponding extension plate 222 corresponds with the insertion space 140 of the male USB connector 10.

The corresponding metallic housing 24 is formed by bending metallic plate and is used to enclose periphery of the corresponding isolation body 22.

The terminals 26*a* and 26*b* are respectively positioned at the corresponding extension plate 222 and penetrates through the corresponding main body 221 so that the terminals 26 can be soldered to the circuit board (not shown). According to the present invention, the terminals 26*a* and 26*b* are manufactured by the insert molding process and positioned within the corresponding isolation body 22.

Reference is made to FIG. 2. An opening 142 is positioned at the top surface of the front metallic housing 14 of the male USB connector 10. A resilient extension 249 is positioned at the top plate of the corresponding metallic housing 24 of the female USB connector 20 by punching process. When the male USB connector 10 is plugged into the female USB connector 20, the opening 142 is used to receive the resilient extension 249 so that it prevents the male USB connector 10 and the female USB connector 20 being separated.

Reference is made to FIGS. 4 and 6. The front metallic housing 14 of the male USB connector 10 has two bended areas 144 at its bottom, and a corresponding bended area 248 is positioned at one side of the bottom surface of the corresponding metallic housing 24 of the female USB connector 20.

Reference is made to FIG. 1. The corresponding metallic housing 24 of the female USB connector 20 has two side plates which respectively have a front extension 242 and a rear extension 244 so that the female USB connector 20 can be fixed to the circuit board. The corresponding metallic housing 24 also has a pair of holding plates 246 to hold the sides of the corresponding main body 221 of the corresponding isolation body 22.

A pair of protrusions 223 are integrally formed with and extend from the corresponding main body 221 of the female USB connector 20 to aid the female USB connector 20 to be fixed at the circuit board.

As described above, advantages of the present invention are in the following.

1. According to the present invention, the male USB connector and the female USB connector of the mini-USB connector assembly respectively have 12 terminals so that transfer speed can be improved.

2. The terminals of the present invention are manufactured by the insert molding process so that the terminals are positioned within the isolation body and the corresponding isolation body without assembling by manpower.

3. According to the present invention, the main body 121 is firmly positioned within the rear metallic housing 16. The main body 121 is not only moved back and forth within the rear metallic housing 16 but the main body 121 is also moved along the vertical direction within the rear metallic housing 16 by the fixing plate 164.

While the invention has been described with reference to the preferred embodiments, the description is not intended to be construed in a limiting sense. It is therefore contemplated that the appended claims will cover any such modifications or embodiments as may fall within the scope of the invention defined by the following claims and their equivalents.

What is claimed is:

1. A mini-USB connector assembly, comprising:

a male USB connector, comprising:

an isolation body, including a main body and an extension plate extending from the main body;

a front metallic housing, enclosed the extension plate, and having a top plate abutted against by a top surface of the extension plate and having a bottom plate abutted against by a top surface of the extension plate so that an insertion space is formed within the top plate and the bottom plate of the extension plate;

an rear metallic housing, used to enclose the periphery of the main body; and a plurality of terminals, formed between a bottom surface of the extension plate and the front metallic housing and manufactured by an insert molding process, and positioned alongside on the bottom surface of the extension plates and penetrating through the main body so that the terminals can be soldered to a circuit board; and a female USB connector, comprising:

a corresponding isolation body, including a corresponding main body and a corresponding extension plate extending from the corresponding main body and positioned within the insertion space;

a corresponding metallic housing, enclosed the corresponding isolation body; and a plurality of corresponding terminals, manufactured by an insert molding process and penetrating through the corresponding main body so that the terminals can be soldered to a circuit board.

2. The mini-USB connector assembly as claimed in claim 1, wherein the main body of the isolation body of the male USB connector respectively has engagement pieces at a top surface and a bottom surface thereof, and a corresponding engagement plate extends from the front metallic housing and has an engagement hole in order to engage with the engagement piece of the main body.

3. The mini-USB connector assembly as claimed in claim 1, wherein the rear metallic housing of the male USB connector is substantially U-shaped.

4. The mini-USB connector assembly as claimed in claim 3, wherein the main body of the isolation body is formed with two guide grooves at two sides thereof, and the rear metallic housing has a pair of side plates, each of the side plates is formed with a fixing plates for respectively pushing against the guide grooves.

5. The mini-USB connector assembly as claimed in claim 4, wherein each of the side plates of the rear metallic housing has two engagement fringes respectively formed at two edges of the side plates, the engagement fringes engage with the main body of the isolation body.

6. The mini-USB connector assembly as claimed in claim 4, wherein each of the side plates of the rear metallic housing has a fixing extension extending from a bottom edge thereof.

7. The mini-USB connector assembly as claimed in claim 1, wherein the front metallic housing of the male USB connector id formed with an opening on the top plate, the corresponding metallic housing of the female USB connector is formed with a resilient extension on the top plate corresponding to the opening, and the resilient extension is received in the opening.

8. The mini-USB connector assembly as claimed in claim 1, wherein the front metallic housing of the male USB connector has two bended areas at the bottom plate, and a corresponding bended area is formed at one side of the bottom surface of the corresponding metallic housing of the female USB connector.

9. The mini-USB connector assembly as claimed in claim 1, wherein the corresponding metallic housing of the female USB connector has a pair of side plates respectively formed with a fixing extension thereon.

10. The mini-USB connector assembly as claimed in claim 1, wherein the corresponding main body of the female USB connector is protruded with a pair of protrusions therefrom.

11. The mini-USB connector assembly as claimed in claim 1, wherein the male USB connector and the female USB connector respectively have 12 terminals.

12. The mini-USB connector assembly as claimed in claim 1, wherein the terminals of the male USB connector and the female USB connector are formed with a soldering end, the soldering ends are arranged in two rows and in a staggered way for being soldered on the PCB.

* * * * *